US005740862A

United States Patent [19]

Sable

[11] Patent Number: 5,740,862

[45] Date of Patent: Apr. 21, 1998

[54] ROD GUIDE ASSEMBLY

[76] Inventor: Donald E. Sable, 4301 Edmondson Ave., Dallas, Tex. 75205

[21] Appl. No.: 828,623

[22] Filed: Mar. 31, 1997

Related U.S. Application Data

[63] Continuation of Ser. No. 373,108, Jan. 17, 1995, abandoned.

[51] Int. Cl.[6] ..... E21B 17/10

[52] U.S. Cl. ..... 166/241.2; 166/241.4

[58] Field of Search ..... 166/241.2, 241.3, 166/241.4, 176, 241.6, 378, 380

[56] References Cited

U.S. PATENT DOCUMENTS

| | | | |
|---|---|---|---|
| 1,605,316 | 11/1926 | Wilson | 166/241.2 |
| 2,127,796 | 8/1938 | Willis | 166/241.3 |
| 4,050,514 | 9/1977 | Prenn | 166/176 |
| 4,757,861 | 7/1988 | Klyne | 166/241.3 |
| 4,919,202 | 4/1990 | Clintberg | 166/241.3 X |
| 4,984,633 | 1/1991 | Langer et al. | 166/241.1 |
| 5,191,938 | 3/1993 | Sable et al. | 166/241.4 X |
| 5,339,896 | 8/1994 | Hart et al. | 166/241.2 X |

*Primary Examiner*—Frank Tsay

[57] ABSTRACT

A rod guide assembly having a mount rigidly molded on rod shank, a centralizer rotatably mounted on the mount having, closure means between the mount and the centralizer for preventing flow of particles into the centralizer.

20 Claims, 5 Drawing Sheets

ROD GUIDE ASSEMBLY

This application is a continuous application of DONALD E. SABLE, Ser. No. 08/373,108 filed Jan. 17, 1995 for Rod Guide Assembly, which is now abandoned.

This invention relates to well tools and more particularly to rod guide assemblies having a mount rigid with the shank of a rod of rotatable sucker rod string and a centralizer disposed on the mount with the mount being rotatable relative to the centralizer.

BACKGROUND OF THE INVENTION

Because of economies of operation, maintenance and repair subsurface well pumps of the progressive cavity type are increasingly being installed to pump well fluids to the surface through a production well tubing by means of a sucker rod string which is rotated at the surface by a suitable drive means. In order to prevent or minimize damage to the rods and to the tubing, it is necessary that the rods of the sucker rod string be held against rubbing movement relative to the tubing and also that the rod guides which are employed to hold the rod string in substantially concentric alignment in the well tubing also not rub either against the rod shanks or against the well tubing. This is achieved by the use of a rod guide assembly which has a mount rigid and concentric with the shank of the rod and a centralizer mounted on and disposed about the mount and held against longitudinal movement relative to the mount, but which permits rotation of the mount relative thereto. Neither the mount nor the centralizer rub against the rod or against the internal surfaces of the well tubing so that wear and damage to the tubing and/or the rod is minimized even at locations where the rods and the tubing are not in concentric relation to one another. Such rod guides are disclosed and described in the U.S. Pat. No. 5,191,938 issued Mar. 9, 1993 to Sable et al and in U.S. Pat. No. 5,339,896 issued Aug. 23, 1994 to Hart et al.

It is found in practice that many and indeed most of the well fluids pumped by such progressive cavity pumps contain not only the desired oil or gas, but also water and various abrasives. Indeed in some wells the well fluids are mostly water with hydrocarbon gas dissolved therein which is recovered when the water is pumped to the surface. It has been found that such abrasives which are carried by the upwardly flowing well fluids penetrate into the spaces between the external bearing surface of the mount and the internal surfaces of the centralizer in which the mount and sucker rod is rotatable when the centralizer is held against rotation by engagement with the internal surfaces of the well tubing at locations where the rod string is not concentric with the well tubing.

It is found that such abrasive erode, abrade or wear away the portion of the mount which slidingly engages the centralizer, held against rotation by engagement with the well tubing, especially in such assemblies wherein the centralizer is of a softer or more resilient substance than the mount since such abrasive particle tend to embed in the centralizer surface and then scrape against the mount. Once the mount portions engaged by the centralizer are worn away, the scraping action damages the rod shank itself and may lead fairly quickly to the breaking of the rod shank because of the extremely high torque stresses exerted on the shanks of the rod string. Such torque stresses are of course increased greatly where the friction between the contacting surfaces of the mount and the centralizer are increased by the enlodgement and scraping of such particles between sliding surfaces of the mount and the centralizer.

In addition, the greater forces that have to be exerted to rotate the rod string increase the cost of operation of the well pump since the energy heated to drive the motor at the surface obviously increases with the frictional loads imposed on the rods as well as the force required to move the column of well fluids from the submerged pump to the surface through the well tubing. It is noted that the cost of pumping the large volumes of well fluids to the surface to obtain a desired quantity or volume of gas or oil may make the cost of recovery of such oil or gas in some wells economically unfeasible.

It is also known that the heat generated at each location of such rod guide assembly due to the sliding contact between the mount and the centralizer is dissipated into the well fluids which flow therepast. The heat is sometimes not properly dissipated, as does happen where the rod guide assemblies are positioned above the static column of well fluids in the well tubing, upon the initiation of the pumping action.

If the centralizers are formed of a plastic, such as polyethylene which has a relatively low melting temperature of about 140 degrees centigrade, the centralizers located a distance above the top of the static column of well fluids actually are damaged beyond use due to the heat generated by the friction between contacting surfaces of the mount and the centralizer before the well fluids being pumped rise to the level above such upwardly placed rod guide assemblies. For example, in a 5,000 foot well, the static column of well fluids may only extend to the lowermost 2,000 feet of the well tubing and the upwardly placed position rod guide assemblies may be spaced a 1,000, 2,000 or more feet above such static column and it takes some time for the pump well fluids to flow upwardly and pass such upwardly positioned rod guide assemblies.

The well fluids not only cool the rod guide assemblies as they flow therepast, but may also help lubricate and thus lessen the friction at the sliding contact surfaces of the rod guide mount and centralizer where the well fluids do not contain appreciable concentrations of abrasives.

It is obvious that the lift of the assemblies may be lengthened appreciably if the friction between the sliding surfaces of the mount and centralizer are lubricated and held out of contact with the well fluids which contain the friction increasing abrasive particles.

It is preferable that the centralizer be formed of a substance which has a relatively high melting temperature, such as Nylon 6 or Nylon 6/6 which have a melting temperature of well over 200 degrees centigrade. For example, glass filled Nylon 6/6 has a melting temperature of 265 degrees centigrade and the copolymer of Nylon 6/6 and Nylon 6 has a melting temperature of 246 degrees centigrade.

It is also obvious that the friction between the mount and the centralizer of assemblies which are spaced above the level of the static column of well fluids and the heat generated thereby would be decreased if a lubricant were present between the centralizer and the mount which would not only decrease friction between the contacting sliding surfaces of the mount and the centralizer, but would also conduct heat away from such contacting surfaces which are pressed against one another with a great force per unit area of contact and thus generate considerable amounts of heat at such locations due to the friction between the rotating mount and the stationary centralizer. The rod string is usually operated at some 600 or more rpm and thus considerable amounts of heat are generated at such frictionally contacting and moving surfaces which if not dissipated or conducted from such surfaces damage the centralizer. In some cases where the rotation of the rod string relative to the centralizer persists over a considerable period of time before cooling by the pumped well fluids can take place, not only does the substance of the plastic centralizer, when formed of a low melting point plastic such as polethylene, melt, but may actually decompose.

The use of the plastic having a low melting point temperature is required where the centralizer is of the form shown in the above referenced U.S. Letters Patent to Hart et al which require that the plastic substance be of sufficient flexibility or resilience that portions thereof be flexible enough to be spread apart to permit mounting of the centralizer on the mount. In the case of one of the forms shown in the patent to Sable et al, a longitudinal portion of the centralizer body is of reduced thickness to permit some flexure of the centralizer to enable it to be placed on the mount. Such weakening of a longitudinal portion of a centralizer is of course undesirable since it reduces the strength of the centralizer against the pressures exerted thereon by the mount and thus will shorten its effective life.

OBJECT OF THE INVENTION

Accordingly, it is an object of this invention to provide a new and improved rod guide assembly for use on the rods of a rotatable rod string.

It is another object of the invention to provide a rod guide assembly whose slidable contact surfaces are isolated from the well fluids being pumped therepast.

Still another object is to provide a rod guide assembly, of the type described, wherein the space between the centralizer and the mount along the areas of possible sliding contact of the mount relative to the centralizer is isolated from the well fluids.

An important object of the invention is to provide a rod guide assembly, of the type described wherein the cylindrical chamber or space between the mount and the centralizer is filled with a non-compressible flowable substance, such as grease or oil.

Another object is to provide a rod guide assembly, of the type described, which has means for permitting the pressure within the chamber between the centralizer and the mount to be equal to that of the pressure in the well tubing externally of the rod guide assembly.

Another object is to provide a rod guide assembly, of the type described, wherein the centralizer is provided with means for permitting the pressure within the chamber to vary in accordance with the pressure in the well tubing at the location of the rod guide assembly.

Still another object of the invention is to provide a rod guide assembly, of the type described, wherein the pressure equalizing means comprises a vent aperture communicating with the chamber.

Another object is to provide a rod guide assembly wherein the mount and the centralizer define a cylindrical chamber closed at both ends by a seal means which prevents passage of abrasive particles into the chamber in which the areas of sliding contact between the mount and the centralizer are located.

Still another object is to provide a rod guide assembly, of the type described, wherein the chamber is filled with a non-compressible flowable substance, such as grease or oil, and with means for permitting the pressure within the chamber to vary as required by the changes in the volume of the chamber or of the flowable substance due to temperature changes as the rod string is made up and lowered into the well tubing so that variations in the volume of the chamber or in the volume of the substance filling the chamber increases or decreases with such temperature changes.

SUMMARY OF THE INVENTION

A rotary guide assembly for a sucker rod having a tubular mount rigid with and on the shank of the rod having an intermediate portion providing a cylindrical bearing surface and spaced stop means at opposite ends of the intermediate portion, the bearing surface being engageable by a centralizer rotatably positioned about the intermediate portion and between the spaced stop means, and closure means for closing the cylindrical chamber in which the bearing surface extends which prevents the passage of solid particles into the chamber.

DESCRIPTION OF THE DRAWINGS

Other objects and advantages of the invention will be readily apparent from the reading of the following description of rod guide assemblies constructed in accordance with the invention and reference to the accompanying drawings, wherein.

The rod guide assembly 10 has a tubular guide mount 20 which is moulded on the rod and is rigid therewith. The mount may be of any suitable hard plastic material such as is available commercially under the trademark "RYTON". The mount is of relatively long length to provide a large area of contact and adherence to the rod and therefore a great resistance to any forces tending to displace or move the mount relative to and on the rod.

Figure 1:
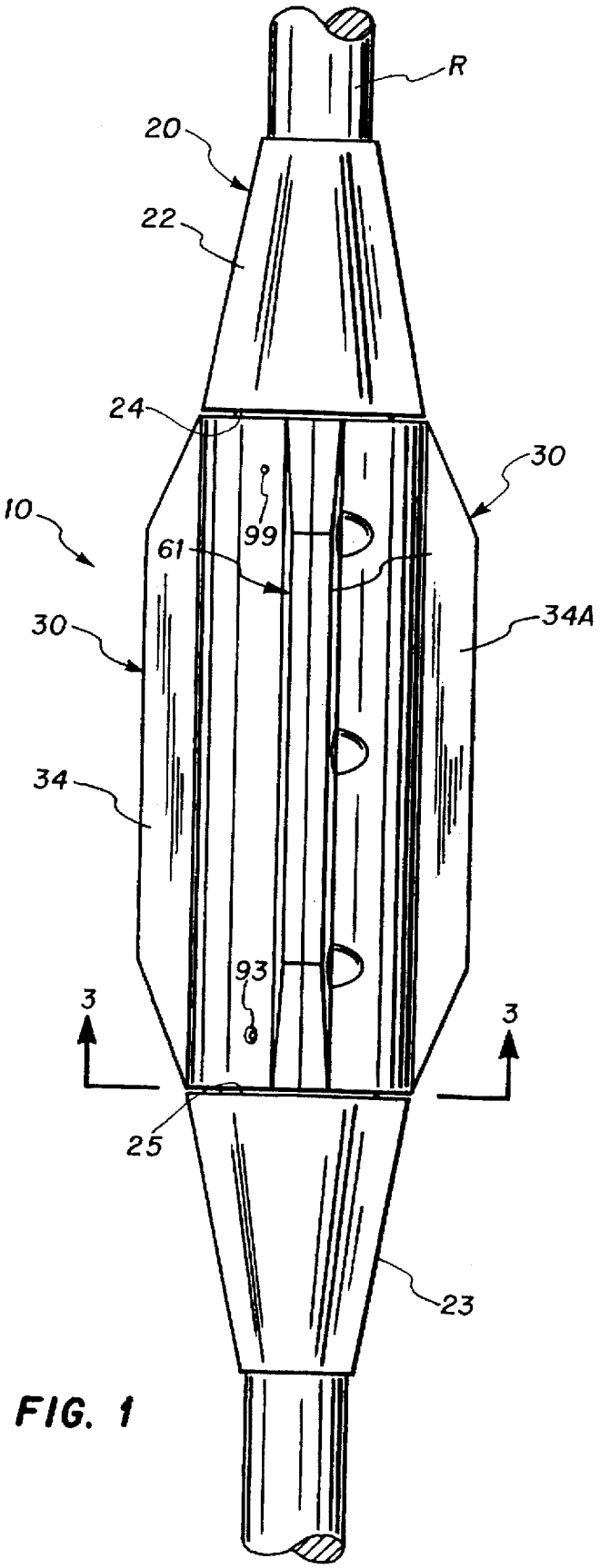
FIG. 1 is a plan view of a rod guide assembly of the invention shown mounted on the shank of a rod.
Figure 2:
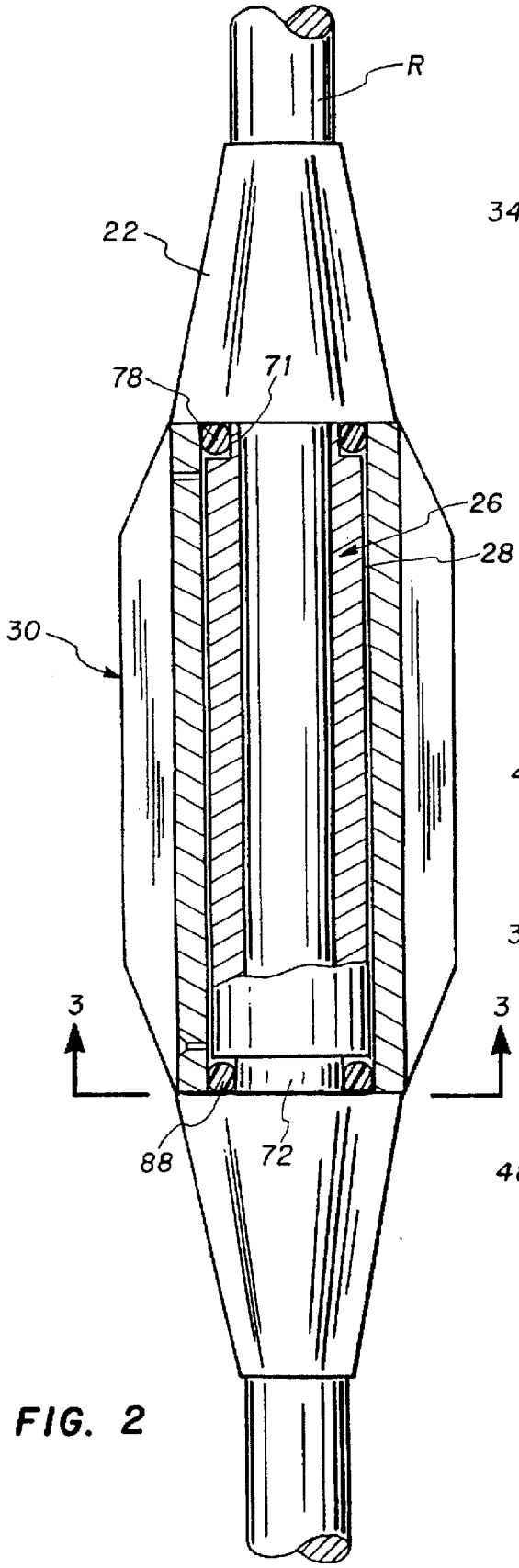
FIG. 2 is a partly sectional view of the rod guide of FIG. 1.
Figure 3:
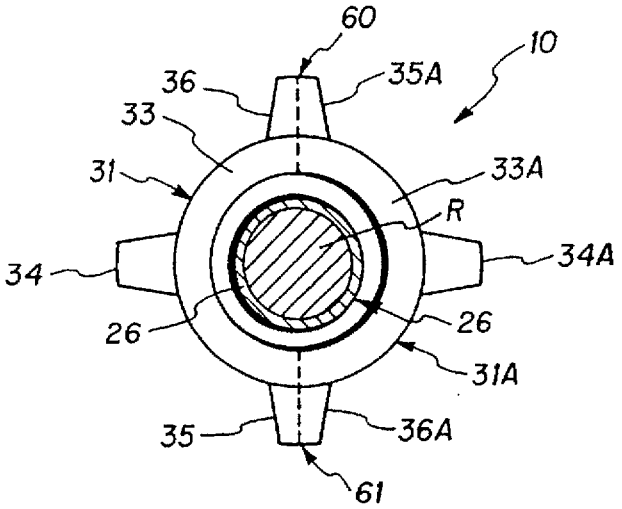
FIG. 3 is a sectional view taken on line 3—3 of FIG. 2.
Figure 4:
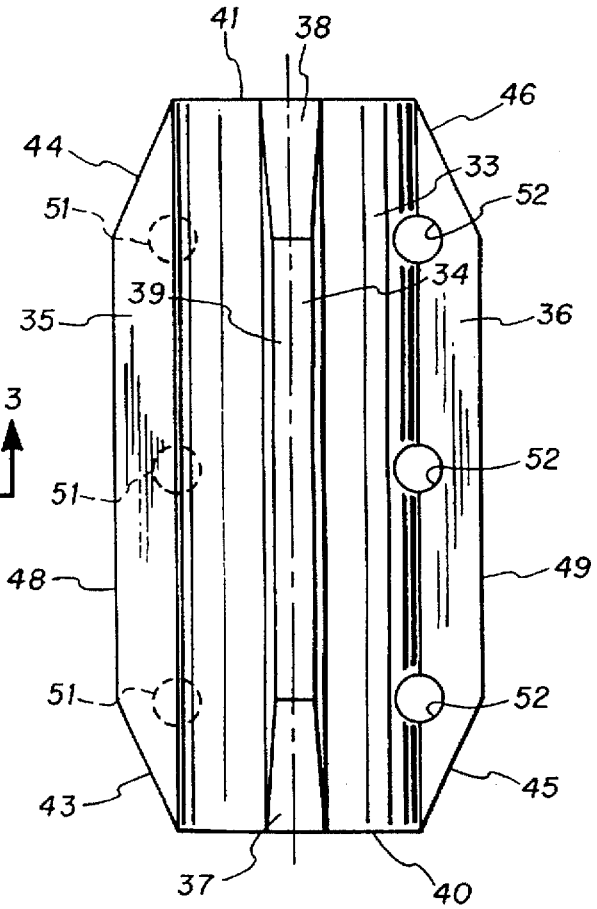
FIG. 4 is a plan view of one side of a section of the centralizer of the rod guide assembly of FIGS. 1, 2 and 3.

The mount 20 is provided at its opposite ends with upper and lower end portions 22 and 23, respectively, which extend upwardly and downwardly divergently to the rod from the facing longitudinally spaced annular stop shoulders or surfaces 24 and 25, respectively. The longitudinal central bushing or bearing portion 26, FIG. 2, of the mount between the stop shoulders is concentric with the rod and provides a smooth cylindrical slice or bearing surface 28 for the rotatable guide or centralizer 30 disposed about the bushing portion between the stop shoulders 24 and 25. The mount is of slightly shorter length than the distance between the stop shoulders 24 and 25.

The rotatable centralizer 30 usable on the mount, FIGS. 1 through 7, is formed of two identical sections 31 and 31A and accordingly, the components of the section 31A have been provided with the same reference numerals, to which the subscript "A" has been added, as the corresponding components of the section 31.

The section 31 has a semi-circular in cross section longitudinal body 33 having a middle longitudinal external rib 34, and rib flanges 35 and 36 extending in opposite directions from the longitudinal edges of the body 33. The rib 34 has beveled shoulders 37 and 38 extending from the outer longitudinal surface 39 divergently outwardly to the end surfaces 40 and 41, respectively, of the body 33.

Similarly, the rib flanges 35 and 36 have beveled shoulders 43 and 44 and 45 and 46, respectively, extending from their outer longitudinal surfaces 48 and 49, respectively, to the end surfaces 40 and 41, respectively, of the body 33.

The rib flange 35 is provided with three locator pins 51 and the rib flange 36 is provided with locater holes 52 aligned with the locater pins 51 so that the two sections 31 and 31A may be properly aligned about the mount 20 to form the tubular centralizer 30 when the locater pins of one section are inserted in the locater holes of the other section.

Figure 5:
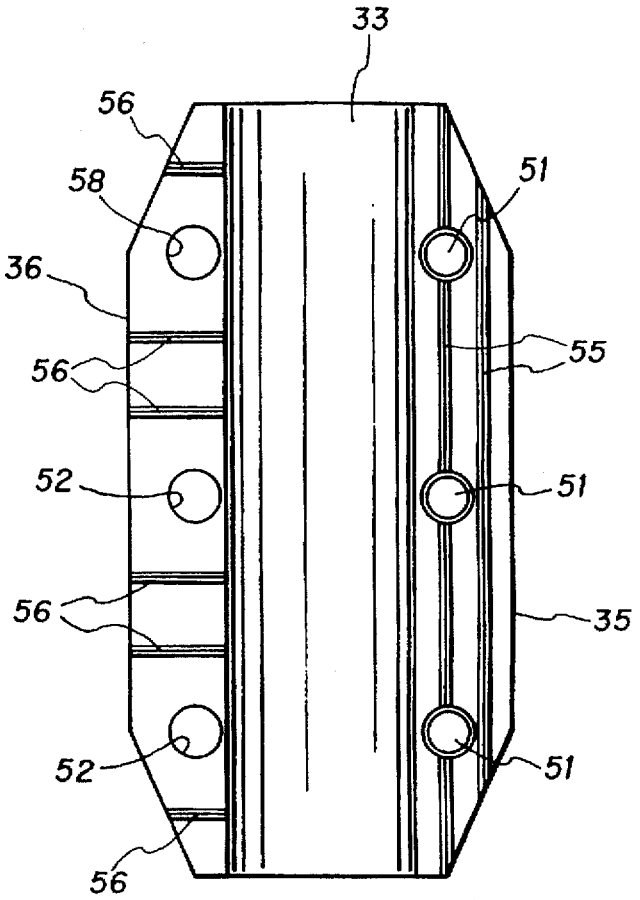
FIG. 5 is a plan view of the other side of the centralizer section illustrated in FIG. 4.

If the centralizer sections 31 and 31A are to be welded to one another by application of ultrasonic energy to their abutting pairs of rib flanges, the rib flanges 35 and 36 are provided with triangular in cross-section energy directors or ridges 55 and 56. As shown in FIG. 5, the ridges or energy directors of one rib flange may extend perpendicular to the energy directors of the other rib flange.

The two sections 31 and 31A are assembled on the mounts and aligned with one another by inserting the locater pins of one section into the locater holes of the other section.

The two pairs of abutting rib flanges of the sections are the positioned between an anvil or support and the actuator of a suitable ultrasonic welder, as is well known to those skilled in the art. Ultrasonic energy of high frequency, e.g., 20 khz or 40 khz, is supplied to the actuator which presses the abutting pairs of the flanges against the anvil and each other. The ultrasonic energy melts the energy directors and abutting portions of the rib flanges, which move into contact with one another as the energy directors melt, to form the ribs 60 and 61 which extend diametrically oppositely outwardly from the section bodies 33 and 33A.

If the two centralizer sections are to be bonded to one another by a bonding agent, such as a solvent which will melt adjacent surface portions of the abutting rib flanges or by an adhesive, the rib flanges are not provided with the energy directors. The rib flanges of the aligned sections which are positioned about and on the mount 20 are held compressed against each other until the abutting rib flanges are bonded or secured to one another.

The centralizer section may be formed of any suitable plastic, such as nylon, or of the same substances, such as "RYTON", as the mount itself.

It will now be seen that the centralizer after it is mounted on the mount 20 constitutes an elongate tubular body having longitudinal radially outwardly extending ribs which are engageable with the internal surface of the well tubing in which the sucker rod is located and that the mount 20 rigid with the rod may rotate relative to the centralizer when the centralizer is held against movement by engagement with the internal surface of the well tubing at locations where the rod is not centrally and concentrically aligned in and with the tubing.

The mount is provided with reduced opposite end portions 71 and 72 to form seal grooves or recesses 73 and 74, respectively. The recess 71 is defined by the inner portion stop shoulder 24, a surface 76 extending substantially parallel to the shoulder 24 and a surface 77 extending perpendicularly to the shoulder 24. An O-ring 78 is disposed in the recess 73 and is compressed between the inner surface 81 of the centralizer and the parallel surface 77 of the reduced portion 71.

Similarly, the seal groove or recess 74 is defined by the inner portion of the stop shoulder 25, the surface 83 which is substantially parallel to the surface 25 and the inner surface 85 of the reduced portion 72. A bottom O-ring 88 is disposed in the recess 74 and compressed between the inner surface 81 of the centralizer and the surface 85 of the reduced portion 72 which defines the inner surface of the seal groove.

The O-rings 77 and 78 are of such diameter that they are at all times compressed between the centralizer and the mount even when the rod and therefore the mount is moved out of concentric alignment with the centralizer when the centralizer engages the internal surface of the well tubing at locations where the rod is not in concentric relation to the well tubing at that location.

The recesses 73 and 74 are of sufficient width and depth that the O-rings may be resiliently deformed without any portions thereof being extruded into the space between the mount and the centralizer when the mount is not in concentric relation with the centralizer.

An inlet or ejection port 93 is located just above the bottom ring 88 and has a conical seal surface 96 which is engageable by a sealable injection syringe or tool 98 so that grease or other fluid, such as oil, may be injected into the cylindrical chamber 90, between the bearing surface 28 of the mount and the interval surface 97 of the centralizer body, whose ends are closed by the O-rings.

The centralizer is also provided with an exhaust or vent hole or port 99 through which gas can escape as the grease or other fluid is injected under pressure into the cylindrical chamber through the injection port.

Figure 8:
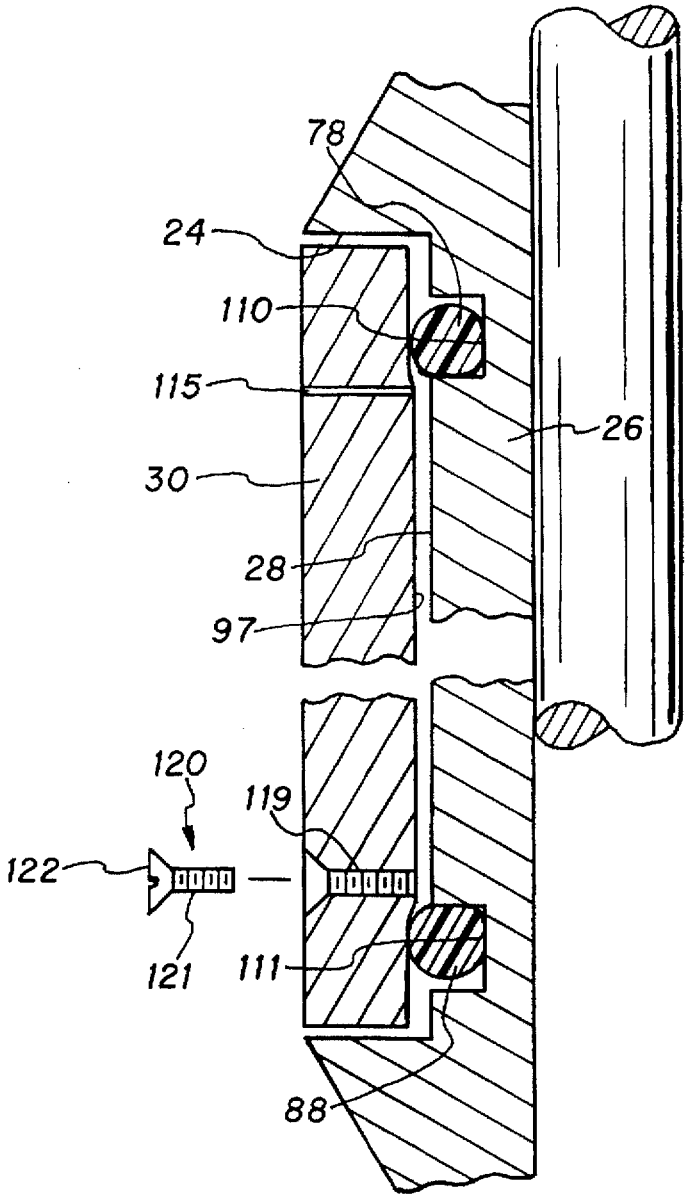
FIG. 8 is a fragmentary sectional view showing a modified form of the rod guide assembly.

Referring now to FIG. 8, if desired separate recesses 110 and 111 may be formed into bushing portion 26 inwardly of the stop shoulders 24 and 25. The injection port 114 and the vent port 115 would then be located just inwardly of the O-rings 88 and 78, respectively, and the end positions of the centralizer body engageable by the O-rings would preferably be spaced outwardly of the internal surface 97 of the centralizer to prevent contact between outer end portions of the mount, located outwardly of the recesses, and aligned portions of the centralizer body.

The mount is molded on the shank of the rod by known injection molding techniques. The O-rings 78 and 88 which are preferably formed of a resilient elastomer are passed over the ends of the sucker rod and over the end portions 22 and 23 of the mount. The particular substance of which the O-rings are formed may be manufactured to have the desired resilience and softness. For example, the O-rings may be of such softness as to permit seepage of fluids, but not of solid particles, between the O-rings and the internal surface of the centralizer at the locations where the O-rings slidably engage the internal surfaces. Alternatively, the O-rings may be fabricated to seal against any movement of fluids therepast into or out of the chamber 90, but would be movable between the stop surfaces 24 arc 76, in the case of the O-rings 78, and between the surfaces 25 and 83 in the case of the O-ring 88, FIG. 7. The two body sections of the centralizer are then positioned about the mount between the stop shoulders 24 and 25 and are joined as discussed above to form a solid tubular body.

Syringe 98 is then employed to inject into the chamber and fill the chamber with a non-compressible but flowable substance such as a grease or oil, the air in the chamber being expelled through the vent aperture 99 as the chamber is filled. In some cases where the O-rings permit seepage of fluids therepast, the centralizer need not be provided with the vent aperture, the air escaping past the O-rings as the pressure in the chamber is increased during the injection of the grease or oil into the chamber.

Figure 6:
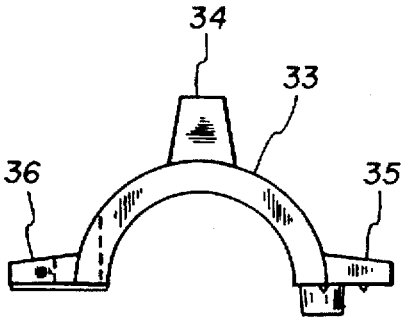
FIG. 6 is an end view of the centralizer shown in FIG. 5.
Figure 7:
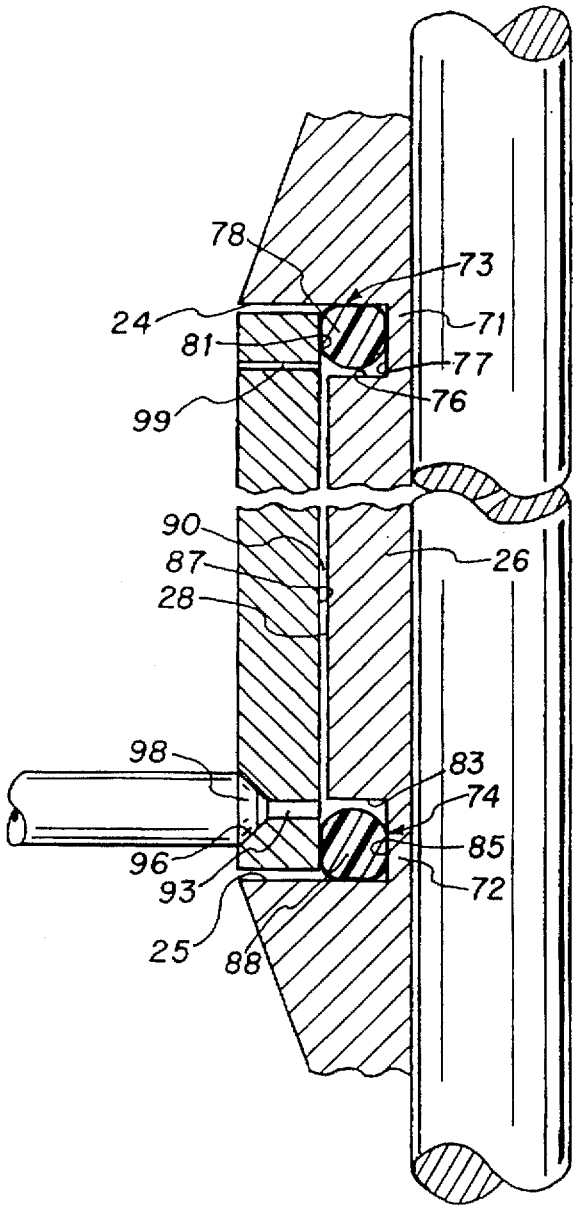
FIG. 7 is a fragmentary, partly sectional view showing the manner in which grease or oil may be injected between the mount and the centralizer.

After the chamber is filled with such substance, a plug 120 may be positioned in the vent hole as shown in FIG. 6. The plug may be threaded as well as the injection aperture to close the injection port or aperture. If then the O-rings 78 and 68 have such properties as to hermetically seal between the mount and the internal surfaces of the centralizer contacted thereby, the vent aperture 115 may be left open so that the variations in pressure between the chamber 90 and the exterior may be equalized. Alternatively, the vent aperture may be closed, or indeed not provided to begin with, the equalization of the pressures within the chamber and externally thereof would be provided for by the movement of the O-rings longitudinally between the stop surfaces 24 and 76 in the case of the O-rings 78 and between the stop shoulders or surfaces 25 and 83 in the case of the O-ring 88.

If the vent aperture is provided and left open it will be apparent that, since the injection aperture is now plugged, while some small movement of fluids can occur between the chamber and the exterior of the centralizer through the vent aperture 99, the amount of fluid displaced either inwardly or outwardly through the vent aperture will be very small and since the vent aperture is of very small diameter very few, if any, solid particles would be able to enter into the chamber if the pressure externally of the centralizer were greater than within the chamber until the pressure in the chamber was equal substantially to the pressure externally thereof so that no pressure differential would exist therebetween.

It will be apparent that since the two sections of the centralizer need not be flexed in any manner, in order to install the centralizer on the mount, the centralizer may be formed of a very rigid plastic which has a high melting temperature, such as the Nylon plastics described above.

When the tubing string has been made up and positioned in the well tubing, the rod guide assemblies mounted on the lower rods of the rod string are positioned within the static column of well fluids present in the well tubing while those mounted on rods located above the static column of well fluids are of course not cooled by the well fluids upon initiation of rotation of the sucker rod string. The chamber, however, being filled with the grease or oil does not have its temperature raised excessively by the friction between the internal surface 87 of the centralizer and the bearing surface 28 of the mount due to the lubricating action of such substance which decreases the friction therebetween and also conducts heat away from the areas of rubbing or sliding contact of the internal surface 87 the centralizer and the bearing surface 28 of the mount.

It will be seen that as the tubing rod string is made up and lowered into the well tubing, the volume of the chamber 90 may increase and that the volume of the grease or oil may expand as their temperature of the assembly is raised. Such variations are accommodated by the movement of the oil or grease out of the chamber through a vent aperture or by the movement of the O-rings as described above.

It will now be seen that a new and improved rod guide assembly has been described and illustrated whose centralizer may be formed of a very rigid tough plastic which has a high melting point so that it will not be damaged during initiation of pumping action where the rod guide assembly is not cooled by the upward flow of pumped well fluids therepast.

It will also be seen that the rod guide assembly is protected from the abrasive particles present in well fluids by the provision of a non-compressible flowable substance, such as grease or oil, which not only diminishs the friction between the rotating mount and the centralizer when the centralizer is held against movement by engagement with the well tubing, but also conducts heat away from the areas of sliding contact of the mount and the centralizer and also prevents passage of abrasive particles into the chamber and into contact with the contracting surfaces of the centralizer and the mount.

It will also been seen that the provision of the means for equalizing the pressure between the chamber in which the bearing surface of the mount is positioned permits the rod guide assembly to accommodate to varying temperature and pressure conditions as the string of sucker rods provided with such rod guide assemblies is lowered into the well tubing.

It will also be seen that the energy necessary to rotate the string during pumping operation of the well is minimized because the resistance causes by the friction between the centralizer and the mount is minimized by the lubricating action of the grease or oil which fills the chamber and also by the prevention of passage of abrasive particles into the chamber which would, as in the devices disclosed in the patents to Sable et al and Hart et al, increase appreciably the friction between the bearing surface of the mount and the internal surface of the centralizer. It will also be seen that several different means for permitting equalization of the pressure in the chamber with the pressure externally of the rod guide assembly have been described and illustrated.

The foregoing description of the invention is explanatory only and changes in the construction described and illustrated may be made by those skilled in the art within the source of the appended claims without departing from the spirit of the invention.

What is claimed is new and desired to be secured by Letters Patent is:

1. A sucker rod guide assembly for the shank of a sucker rod positionable in a well tubing, said assembly including, a centralizer mount having a tubular body on and rigid with the shank of a sucker rod, said body having an elongate intermediate portion having a longitudinally extending bearing surface concentric with the longitudinal axis of the rod and end portions at opposite ends of said intermediate portion extending radially outwardly of said intermediate portion, said end portions having spaced facing stop shoulders; a tubular centralizer rotatably disposed on said body about said intermediate portion and said bearing surface portion and between said stop shoulders, said stop shoulders limiting longitudinal movement of said centralizer on said intermediate portion, said centralizer having a tubular body having end surfaces engageable with said stop shoulders of said mount; and tubing engageable means extending from said tubular body radially outwardly of said stop shoulders of said mount, said centralizer having an internal cylindrical surface of greater radius than the radius of said bearing surface whereby a chamber is provided between said bearing surface and the internal surfaces of said tubular body; and closure means at opposite ends of said chamber and engaged with said centralizer and said mount for preventing entry therepast of solid particles into said chamber.

2. The assembly of claim 1, said assembly having means for equalizing pressure in between said chamber and said well tubing.

3. The assembly of claim 2 wherein said pressure equalizing means comprise said closure means which permit seepage of fluids therepast between said chamber and the exterior of said assembly, but prevent passage of solid particles therepast.

4. The assembly of claim 1 wherein said closure means are longitudinally movable on said mount by pressure differentials between said chamber and the exterior of said assembly to prevent pressure differentials to persist between said chamber and the exterior of said assembly.

5. The assembly of claim 2, said equalizing means comprising vent means provided in said centralizer communicating with said chamber and the exterior.

6. The assembly of claim 1, said assembly including a non-compressible flowable substance in said chamber between said closure means.

7. The assembly of claim 6, said assembly having pressure equalizing means for maintaining the pressure in said chamber substantially equal to the pressure externally of said assembly.

8. The assembly of claim 7, wherein said pressure equalizing means comprise said closure means which permit seepage of fluids therepast between said chamber and the exterior of said assembly, but prevent passage of solid particles therepast.

9. The assembly of claim 6, wherein said closure means are longitudinally movable on said mount by pressure differentials between said chamber and the exterior of said assembly to prevent pressure differentials to persist between said chamber and the exterior of said assembly.

10. The assembly of claim 6, and pressure equalizing means comprising vent means provided in said centralizer for communicating with said chamber and the exterior.

11. The assembly of claim 1, wherein said centralizer is of a substance having a melting temperature of not less than 225 degrees centigrade.

12. The assembly of claim 1, said assembly including a non-compressible flowable lubricant substance in said chamber between said closure means.

13. The assembly of claim 12, said assembly having pressure equalizing means for maintaining the pressure in said chamber substantially equal to the pressure externally of said assembly.

14. The assembly of claim 13, wherein said pressure equalizing means comprise said closure means which permit seepage of fluids therepast between said chamber and the exterior of said assembly, but prevent passage of solid particles therepast.

15. The assembly of claim 12, wherein said closure means are longitudinally movable on said mount by pressure differentials between said chamber and the exterior of said assembly to prevent pressure differentials to persist between said chamber and the exterior of said assembly.

16. The assembly of claim 12, said equalizing means comprising vent means provided in said centralizer for communicating with said chamber and the exterior.

17. A sucker rod guide assembly for the shank of a sucker rod positionable in a well tubing, said assembly including: a centralizer mount having a tubular body on and rigid with the shank of a sucker rod; said body having an elongate intermediate portion having a longitudinally extending bearing surface concentric with the longitudinal axis of the rod and end portions at opposite ends of said intermediate portion extending radially outwardly of said intermediate portion, said end portions having spaced facing stop shoulders; a tubular centralizer rotatably disposed on said body about said intermediate portion and said bearing surface portion and between said stop shoulders, said stop shoulders limiting longitudinal movement of said centralizer on said intermediate portion, said centralizer having a tubular body having end surfaces engageable with said stop shoulders of said mount, and tubing engageable means extending from said tubular body radially outwardly of said mount, said centralizer having an internal cylindrical surface engageable with said bearing surface and closure means at opposite ends of said intermediate portion engaged with said centralizer and said mount for preventing entry of solid particles therepast to said bearing surface.

18. The assembly of claim 17, said assembly having equalizing means for maintaining the pressure within said centralizer between said closure means substantially equal to the pressure externally of said assembly.

19. The assembly of claim 18, said assembly including a non-compressible flowable substance in said centralizer between said closure means.

20. The assembly of claim 19, wherein said non-compressible flowable substance is a lubricant.

* * * * *